US006973912B1

(12) United States Patent
Shimatsu et al.

(10) Patent No.: US 6,973,912 B1
(45) Date of Patent: Dec. 13, 2005

(54) METHOD OF CONTROLLING OPERATION OF INTERNAL COMBUSTION ENGINE

(75) Inventors: Takayuki Shimatsu, Tochigi-ken (JP); Shogo Hattori, Tochigi-ken (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/109,800

(22) Filed: Apr. 20, 2005

(30) Foreign Application Priority Data

Sep. 29, 2004 (JP) ..... 2004-284271
Sep. 29, 2004 (JP) ..... 2004-284306

(51) Int. Cl.[7] ..... F02D 41/14
(52) U.S. Cl. ..... 123/339.1; 123/399; 123/480; 701/103
(58) Field of Search ..... 123/339.1, 399, 123/480, 494; 701/103, 115; 73/118.2

(56) References Cited

U.S. PATENT DOCUMENTS 4,765,299 A * 8/1988 Wataya et al. ..... 123/339.15
4,974,563 A * 12/1990 Ikeda et al. ..... 123/494
6,363,316 B1 * 3/2002 Soliman et al. ..... 701/104
6,539,785 B1 * 4/2003 Nagaishi ..... 73/118.2
6,792,927 B2 * 9/2004 Kobayashi ..... 123/673
6,820,595 B2 * 11/2004 Kobayashi et al. ..... 123/478
2003/0070494 A1 4/2003 Kanke et al. ..... 123/694
2004/0118376 A1 6/2004 Dohta ..... 123/339.8

FOREIGN PATENT DOCUMENTS

JP 3-233168 10/1991
JP 2887111 2/1999
JP 2001-82260 3/2001
JP 2002-364469 12/2002
JP 2003-120406 4/2003
JP 2004-190591 7/2004

* cited by examiner

*Primary Examiner*—Hai Huynh
(74) *Attorney, Agent, or Firm*—Squire, Sanders & Dempsey LLP

(57) ABSTRACT

An amount-of-air detecting time period Ti is preset based on an intake time period Tr during which intake air is actually drawn into a cylinder chamber. An intake air amount average value Qa during a time period, other than the time period Ti, between intake strokes is calculated. After confirmation that one half or more of an amount-of-air detecting time period Ti(n+1) has elapsed, an integrated value of the intake air amount is multiplied by a correcting coefficient Ka, and divided by the amount-of-air detecting time period Ti(n+1), thereby calculating an intake air amount Qin during the amount-of-air detecting time period Ti(n+1). The average value Qa of the intake air amount is subtracted from the amount Qin during the amount-of-air detecting time period Ti(n+1), thereby calculating an estimated amount Qp of intake air introduced into the cylinder chamber.

4 Claims, 7 Drawing Sheets

METHOD OF CONTROLLING OPERATION OF INTERNAL COMBUSTION ENGINE

BACKGROUND OF THE INVENTION

1. Field of the Invention

The present invention relates to a method of controlling operation of an internal combustion engine by detecting an amount of intake air introduced into the internal combustion engine and controlling the internal combustion engine based on the detected amount of intake air.

2. Description of the Related Art

Internal combustion engines that have been used on motor vehicles or the like have intake pipes for introducing intake air into the cylinders, which provide combustion chambers and intake valves mounted in respective intake ports, and to which the respective intake pipes are connected, for selectively bringing the cylinders into and out of communication with the respective intake pipes. When the intake valves are opened, intake air is introduced through the intake pipes into the cylinders.

The intake pipes are connected to a throttle valve for regulating the rate of intake air (amount of intake air) flowing through the intake pipes. The throttle valve has a valve opening thereof adjusted to regulate the amount of intake air being introduced into the cylinders. An air flow sensor for measuring or detecting the amount of intake air flowing through the intake pipes is disposed upstream of the throttle valve. A surge tank is connected to the intake pipes downstream of the throttle valve and has a pressure sensor for detecting the air pressure in the intake pipes.

A detected signal from the air flow sensor is output to a control circuit, which calculates the amount (mass or volume) of intake air being introduced into the cylinders from the detected signal from the air flow sensor. Then, the control circuit calculates an optimum amount of fuel to be injected into the cylinders depending on the operating state of the internal combustion engine based on the calculated amount of intake air. The control circuit then outputs a control signal representing the calculated optimum amount of fuel to a fuel injector, thereby controlling operation of the fuel injector. For further details, see Japanese Laid-Open Patent Publication No. 2004-190591, for example.

According to the conventional control system disclosed in Japanese Laid-Open Patent Publication No. 2004-190591, when the throttle valve is quickly opened to accelerate the motor vehicle quickly, intake air for filling the surge tank connected to the intake pipes is introduced into the intake pipes, in addition to the intake air that is actually introduced into the cylinders. Therefore, the amount of intake air that is detected by the air flow sensor is the sum of intake air actually introduced into the cylinders and a portion of the intake air filling the intake pipes.

The pressure sensor, which is disposed downstream of the throttle valve separately from the air flow sensor, detects the pressure of intake air filling the intake pipes, and the control circuit estimates the amount of intake air filling the intake pipes. The control circuit is required to subtract the estimated amount of intake air from the total amount of intake air detected by the air flow sensor, thereby estimating the amount of intake air that is actually drawn into the cylinders, for controlling the internal combustion engine.

With the above conventional control system, however, the amount of intake air drawn into the cylinders is estimated based on the amount of intake air detected by the air flow sensor disposed upstream of the throttle valve and the pressure detected by the pressure sensor. Consequently, the control system fails to accurately recognize the amount of intake air actually introduced into the cylinders, which makes it difficult to accurately control the amount of fuel injected into the cylinders based on the amount of intake air.

SUMMARY OF THE INVENTION

It is a general object of the present invention to provide a method of controlling operation of an internal combustion engine highly accurately, based on a highly accurate detected amount of intake air introduced into the cylinders of the internal combustion engine.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
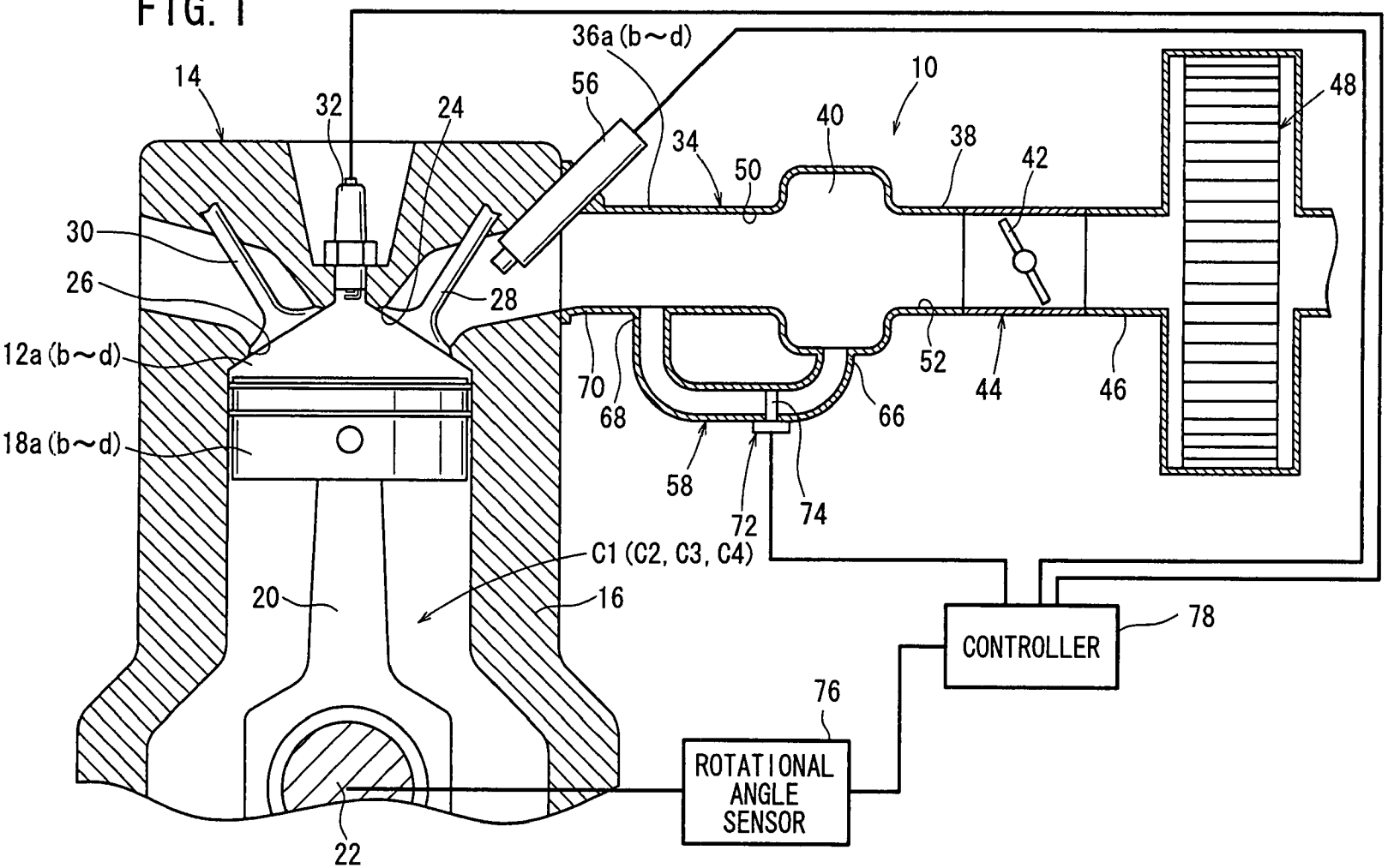
FIG. 1 is a schematic cross-sectional view, partly in block form, of an intake system of an internal combustion engine, to which a method of controlling operation of an internal combustion engine according to the present invention is applied.
Figure 2:
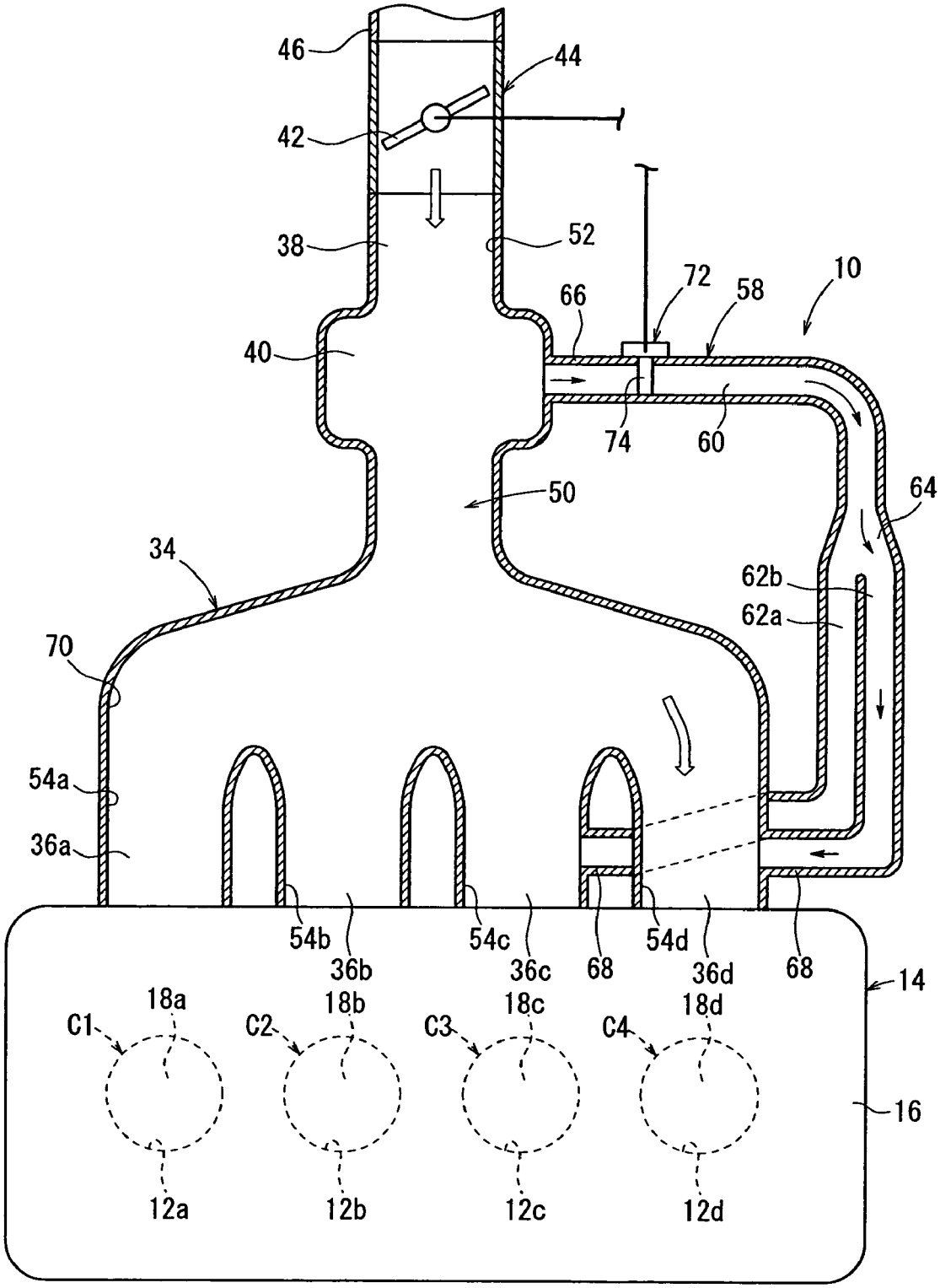
FIG. 2 is a horizontal cross-sectional view of a portion, including an intake manifold, of the intake system shown in FIG. 1.

FIG. 1 shows an intake system 10 to which a method of controlling operation of an internal combustion engine according to the present invention is applied. FIGS. 1 and 2 schematically show the intake system 10 of an internal combustion engine, which is a multi-cylinder internal combustion engine having a plurality of cylinders.

The intake system 10 is combined with an engine (internal combustion engine) 14 having, for example, four cylinders, i.e., first through fourth cylinder chambers 12*a* through 12*d* (see FIG. 2), for use on a motor vehicle, e.g., an automobile, a motorcycle, or the like.

As shown in FIGS. 1 and 2, the engine 14 has first through fourth pistons 18*a* through 18*d* (see FIG. 2) displaceably disposed respectively in the first through fourth cylinder chambers 12*a* through 12*d* defined in an engine body (main body) 16. When the first through fourth pistons 18*a* through 18*d* are displaced during their stroke, the volumes of the respective first through fourth cylinder chambers 12*a* through 12*d* are changed to cause the engine 1 to operate in intake, compression, power, and exhaust strokes.

Displacement of the first through fourth pistons 18*a* through 18*d* is output as drive power of the engine 14, from the first through fourth pistons 18*a* through 18*d* through connecting rods 20 and a crankshaft 22. The first through fourth pistons 18*a* through 18*d* and the first through fourth cylinder chambers 12*a* through 12*d* define a first cylinder C1, a second cylinder C2, a third cylinder C3, and a fourth cylinder C4 (see FIG. 2).

The engine body 16 has intake ports 24 and exhaust ports 26 defined therein. The intake ports 24 open into the respective first through fourth pistons 18*a* through 18*d*, and the exhaust ports 26 also open into the respective first through fourth pistons 18*a* through 18*d*. Intake valves 28 are operatively disposed in the respective intake ports 24, and exhaust valves 30 are operatively disposed in the respective exhaust ports 26. Spark plugs 32 are disposed in the engine body 16 at upper ends of the respective first through fourth cylinder chambers 12*a* through 12*d*, between the intake ports 24 and the exhaust ports 26.

The intake ports 24, which open into the respective first through fourth cylinder chambers 12*a* through 12*d*, are connected respectively to first through fourth parallel branch pipes 36*a* through 36*d* (see FIG. 2) of an intake manifold 34.

The intake manifold 34 has the first through fourth branch pipes 36*a* through 36*d*, which are branched downstream thereof, a common pipe 38 extending upstream of the first through fourth branch pipes 36*a* through 36*d*, and a tank 40, which has a predetermined volume, interconnecting the first through fourth branch pipes 36*a* through 36*d* and the common pipe 38.

A throttle body 44 including a throttle valve 42 that can be opened and closed in co-operated relation to an accelerator pedal (not shown) is disposed upstream of the common pipe 38. An air cleaner 48 (see FIG. 19) is disposed upstream of and connected to the throttle body 44 by an intake pipe 46. Intake air is introduced through the air cleaner 48 into the intake manifold 34. At this time, the air cleaner 48 removes dust particles from the intake air as it passes through the air cleaner 48.

Figure 3:
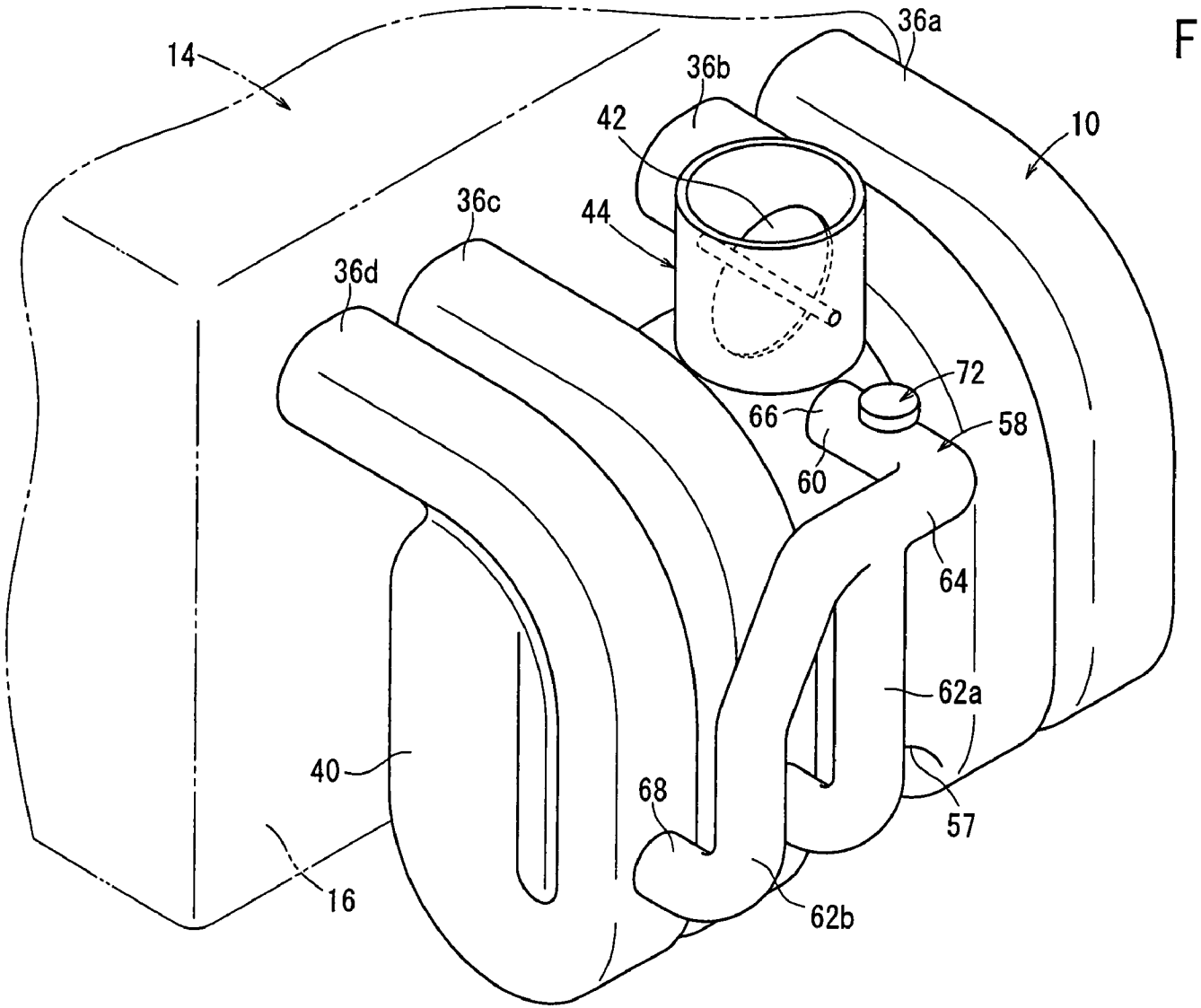
FIG. 3 is a perspective view of the intake manifold of the intake system shown in FIG. 1.
Figure 5:
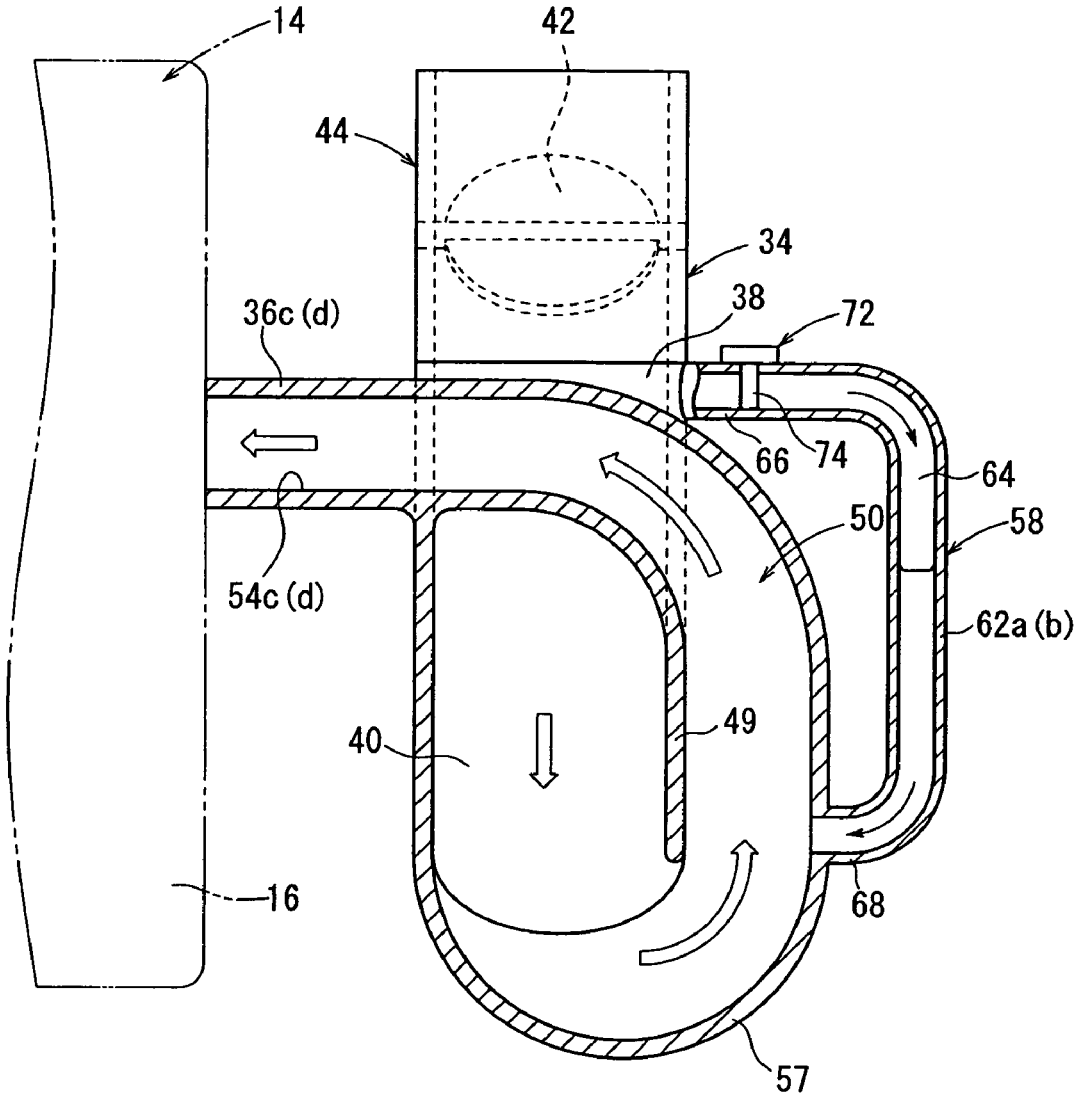
FIG. 5 is a vertical cross-sectional view taken along line V—V of FIG. 4.

Structural details of the intake manifold 34 will be described below with reference to FIGS. 3 and 5. The intake manifold 34 is of a down-draft type, wherein the common pipe 38 and the first through fourth branch pipes 36*a* through 36*d* extend in parallel to each other.

The common pipe 38, which is in the form of a substantially cylindrical tube, is positioned centrally in the intake manifold 34, and is joined to the tank 40, which is of a substantially rectangular shape and has an increased width in a direction substantially perpendicular to the axis of the common pipe 38. As shown in FIG. 5, the first through fourth branch pipes 36*a* through 36*d* connected to the tank 40 extend a predetermined distance toward the common pipe 38, along a partition wall 49 between themselves and the tank 40, and then are curved to extend toward the engine body 16 in a direction substantially perpendicular to the axis of the common pipe 38.

The intake manifold 34 has defined therein an intake passage (main intake passage) 50 through which intake air flows. The intake passage 50 comprises a common passage 52 defined in the common pipe 38 and a plurality of branch passages 54*a* through 54*d* (see FIG. 2) defined respectively in the first through fourth branch pipes 36*a* through 36*d*. Injectors 56 (see FIG. 1), which function as fuel injection valves, are disposed in the portions of the first through fourth branch pipes 36*a* through 36*d* that are joined to the intake ports 24 in confronting relation to the intake ports 24. The injectors 56 inject fuel into the first through fourth branch pipes 36*a* through 36*d*, under control of an electric signal supplied from a controller 78 (see FIG. 1).

Figure 4:
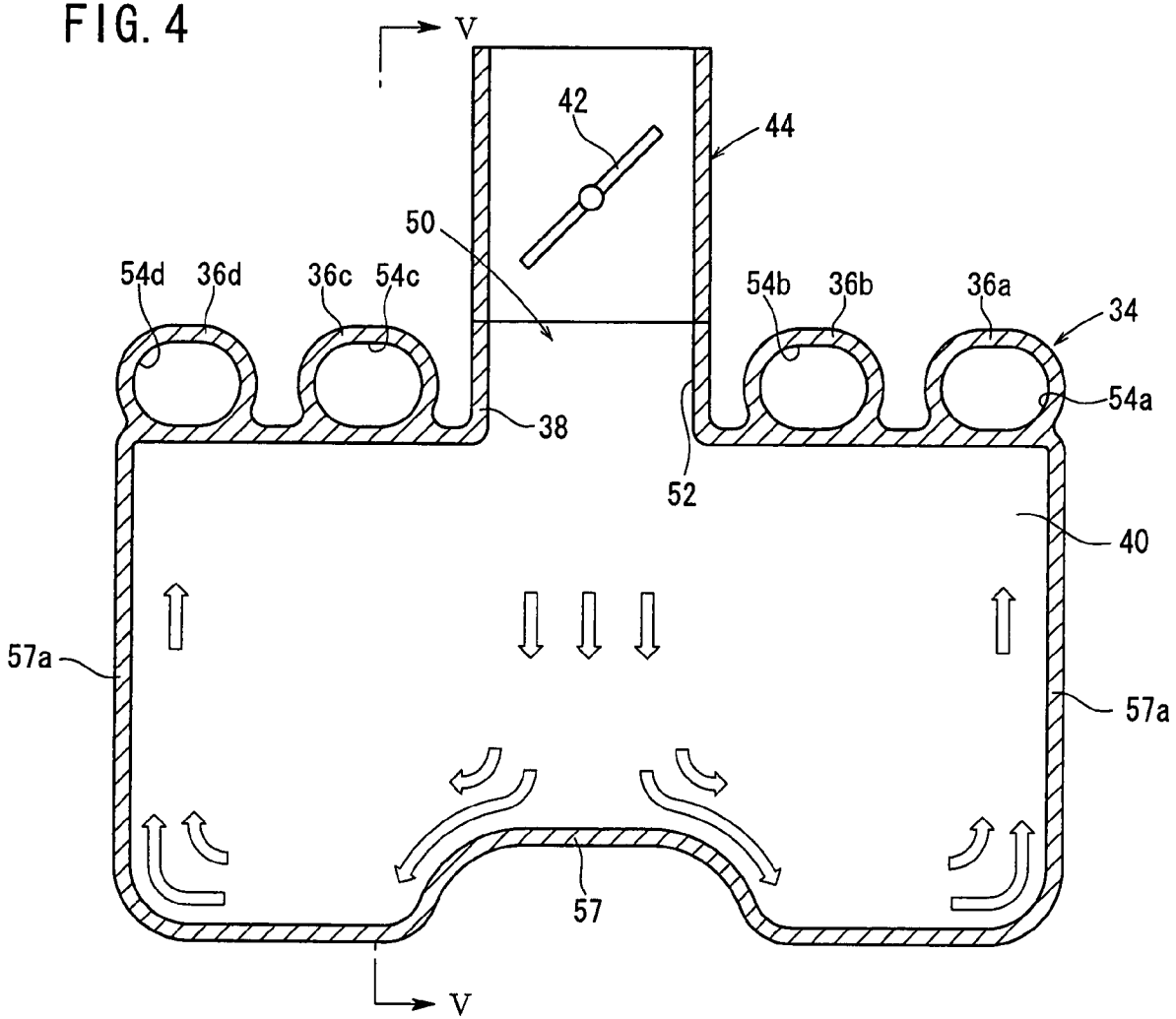
FIG. 4 is a vertical cross-sectional view of the intake manifold shown in FIG. 3.

Specifically, when intake air is introduced from the air cleaner 48 into the intake manifold 34, it flows through the common passage 52 into the tank 40 as the throttle valve 42 is opened. The intake air temporarily fills the tank 40, and then is distributed from the tank 40 into the first through fourth branch pipes 36*a* through 36*d*. As shown in FIG. 4, when the intake air flows from the common pipe 38 into the tank 40, the intake air hits a wall surface 57 of the tank 40, which confronts the common pipe 38, and then flows along opposite side walls 57*a* of the tank 40.

During the compression, power, and exhaust strokes, other than the intake stroke, of the engine 14, when intake air is introduced from the common pipe 38 into the tank 40, the pressure of the intake air near the side walls 57*a* of the tank 40 is higher than the pressure in regions of the tank 40 spaced from the side walls 57*a*, and the intake air flows faster near the side walls 57*a*.

Stated otherwise, since the first and fourth branch pipes 36*a*, 36*d* are disposed adjacent to the side walls 57*a* of the tank 40, which are substantially parallel to the axis of the common pipe 38, the pressure in and near the first and fourth branch pipes 36*a*, 36*d* is higher. The pressure in the second and third branch pipes 36*b*, 36*c* that are disposed in a substantially central portion in the intake manifold 34 and spaced from the side walls 57*a* is lower than the pressure in and near the first and fourth branch pipes 36*a*, 36*d*.

As shown in FIGS. 1 and 2, a bypass pipe (auxiliary intake passage) 58, for bypassing the manifold section between the tank 40 or the common pipe 38 and the first through fourth branch pipes 36*a* through 36*d*, is connected to the intake manifold 34.

The bypass pipe 58 has an upstream inlet 60 connected to the tank 40 or the common pipe 38, a pair of downstream branches 62*a*, 62*b* connected to some of the first through fourth branch pipes 36*a* through 36*d*, and a joint 64 joining the branches 62*a*, 62*b* to the inlet 60. It is assumed that the branches 62*a*, 62*b* are provided as bifurcated pipe members, and connected respectively to the third and fourth branch pipes 36*c*, 36*d* of the intake manifold 34.

The bypass pipe 58 is not limited to a pipe having bifurcated branches as shown, but may be a pipe having four branches associated respectively with the first through fourth branch pipes 36*a* through 36*d*, or a single pipe connected to either one of the first through fourth branch pipes 36*a* through 36*d*.

The bypass pipe 58 has a first connecting end 66 on the inlet 60, which is connected to the tank 40 or the common pipe 38, for holding the bypass pipe 58 and the common passage 52 in communication with each other.

The bypass pipe 58 has second connecting ends 68 on the branches 62*a*, 62*b*, which are connected to pipe walls 70 of the third and fourth branch pipes 36*c*, 36*d*, respectively, for holding the bypass pipe 58 and the branch passages 54*c*, 54*d* in communication with each other. The inlet 60, the branches 62*a*, 62*d*, and the joint 64 of the bypass pipe 58 are thinner, i.e., smaller in diameter, than the common pipe 38 and the first through fourth branch pipes 36*a* through 36*d* of the intake manifold 34.

The upstream first connecting end 66 of the bypass pipe 58 is not necessarily connected to the tank 40 or the common pipe 38, but may directly be connected to the intake manifold 34 near the throttle body 44. The downstream second connecting ends 68 may be connected to the engine body 16 downstream of the intake manifold 34.

An air flow meter (amount-of-air detector) 72 for detecting an amount of intake air flowing through the bypass pipe 58 is disposed in the inlet 60 of the bypass pipe 58. The air flow meter 72, which functions as an amount-of-air detector, is located at a position where the intake air flows in a stable laminar flow through the bypass pipe 58. The air flow meter 72 may be disposed in the joint 64 of the bypass pipe 58, rather than the inlet 60 thereof. That is, the air flow meter 72 may be disposed in any position where the intake air flows in a stable laminar flow through the bypass pipe 58, allowing the air flow meter 72 to reliably detect an amount of intake air flowing through the bypass pipe 58.

The air flow meter 72 has a detecting element 74, which may comprise a silicon chip with a thin film of platinum evaporated thereon, for example. When intake air flows around the detecting element 74, the detecting element 74 changes in temperature, causing a change in the amount of current that is supplied to the detecting element 74 to keep the temperature of the detecting element 74 constant. The air flow meter 72 comprises a hot-wire type, which detects the change in the supplied amount of current, thereby detecting the amount of intake air flowing through the bypass pipe 58.

The air flow meter 72 is not required to be a hot-wire type, but may be of any of various types. For example, the air flow meter 72 may be a Karman vortex type meter, for detecting a volumetric amount of intake air flowing through the bypass pipe 58, by detecting vortexes generated downstream of a resistive member that is disposed in the bypass pipe 58 as a flow resistance member, or the air flow meter 72 may be a flap type meter, for detecting a volumetric amount of intake air flowing through the bypass pipe 58 by detecting an angular displacement of a flap that is pushed by the intake air flowing through the bypass pipe 58.

The intake system 10, to which a method of controlling operation of an internal combustion engine according to the present invention is applied, is basically constructed as described above. Operations and advantages of the intake system 10 will be described below.

With the engine 14 started, the driver of the motor vehicle depresses the accelerator pedal (not shown) to open the throttle valve 42. During the intake stroke, when the intake valves 28 are lifted off their valve seats in the intake ports 24, and the first through fourth pistons 18*a* through 18*d* are successively displaced downwardly, intake air is introduced from the air cleaner 48 (see FIG. 1) into the intake manifold 34, under an intake negative pressure developed in the first through fourth cylinder chambers 12*a* through 12*d*.

Part of the intake air that is introduced through the throttle valve 42 into the intake passage 50 is introduced through the tank 40 from the first connecting end 66 into the inlet 60. At this time, the air flow meter 72 on the bypass pipe 58 detects the amount of intake air, which flows in a stable laminar flow through the bypass pipe 58.

Angular displacement of the crankshaft 22 or a camshaft of the engine 14 is detected by a rotational angle sensor 76, which outputs a detected signal to the controller 78. Based on the detected signal from the rotational angle sensor 76, the controller 78 identifies which one of the first through fourth cylinders C1 through C4 currently is in its intake stroke.

Stated otherwise, the controller 78 confirms which of the first through fourth cylinders C1 through C4 is being supplied with intake air, based on the detected signals from the rotational angle sensor 76 and the air flow meter 72. Accordingly, the amount of intake air drawn into each of the first through fourth cylinder chambers 12*a* through 12*d* can be detected by a single air flow meter 72.

For example, as shown in FIG. 2, when the fourth cylinder C4, which includes the fourth piston 18*d* and the fourth cylinder chamber 12*d*, is in the intake stroke, intake air flows into the branch passage 54*d* in the fourth branch pipe 36*d* that is connected to the fourth cylinder chamber 12*d* as the fourth piston 18*d* is displaced in its stroke. Part of the intake air that is introduced into the bypass pipe 58 flows into the branch 62*b*, after the amount thereof has been detected by the air flow meter 72. Then, the intake air flows from the bypass pipe 58 into the branch passage 54*d* of the intake manifold 34, where it is combined with the intake air flowing through the branch passage 54*d*, after which the combined intake air flows from the branch passage 54*d* into the fourth cylinder chamber 12*d*.

The air flow meter 72 outputs a detected signal, which represents the amount of the intake air flowing through the bypass pipe 58, to the controller 78 (see FIG. 1), wherein the controller 78 calculates the actual amount of intake air flowing into the fourth branch pipe 36*d*, and also calculates an optimum amount of fuel to be injected with respect to the amount of intake air. The controller 78 applies a control signal based on the calculated optimum amount of fuel to be injected to the injector 56, which injects the calculated amount of fuel into the intake air flowing through the intake passage 50 near the intake port 24. The mixture of the fuel and the intake air is now introduced into the fourth cylinder chamber 12*d*.

The intake stroke of each of the first through third cylinders C1 through C3 is the same as described above for the intake stroke of the fourth cylinder C4, and will not be described below.

In the intake system 10, when intake air is introduced into the intake manifold 34, since the pressure of intake air near the first and fourth branch pipes 36*a*, 36*d* that are positioned adjacent to the side walls 57*a* of the tank 40 is higher, the intake air flows faster.

Therefore, the intake air that fills the tank 40 tends to flow through the first and fourth branch pipes 36*a*, 36*d* back into the bypass pipe 58. At this time, the air flow meter 72 detects the amount of intake air flowing forwardly downstream in the bypass pipe 58 from the first connecting end 66 to the second connecting end 68, and additionally detects the amount of intake air flowing backward upstream in the bypass pipe 58 from the second connecting end 68 to the first connecting end 66.

A process for estimating an amount of intake air that is actually drawn into the fourth cylinder chamber 12*d* of the engine 14 by the intake system 10, when intake air flows backward upstream in the bypass pipe 58, will be described in detail below with reference to FIGS. 6 and 7.

Figure 6:
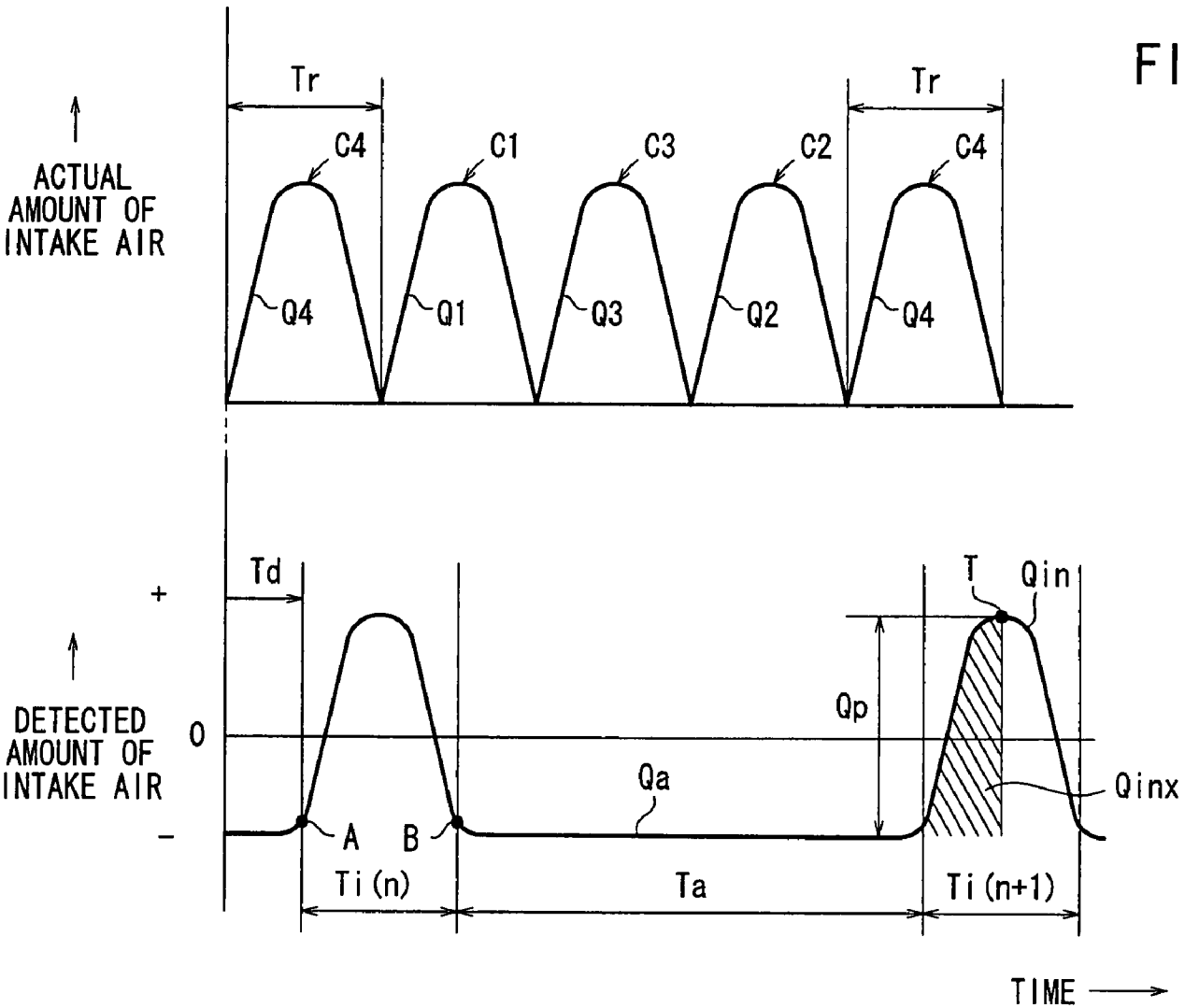
FIG. 6 is a diagram showing the relationship between amounts of intake air introduced into first through fourth cylinders, respectively, which are detected by the intake system, an amount of introduced intake air detected by an air flow meter, and time.

FIG. 6 shows, in an upper section thereof, the relationship between actual amounts Q1 through Q4 that are actually drawn into the first through fourth cylinder chambers 12*a* through 12*d* and time, and also shows, in a lower section thereof, the relationship between a detected amount of intake air that flows through the bypass pipe 58 and is detected by the air flow meter 72 and time. The detected amount of intake air that is detected by the air flow meter 72, shown in the lower section of FIG. 6, includes an amount of intake air flowing forwardly downstream in the bypass pipe 58, which is illustrated in an upper zone (indicated by +in FIG. 6) above a horizontal reference line 0, and an amount of intake air flowing backward upstream in the bypass pipe 58, which is illustrated in a lower zone (indicated by—in FIG. 6) beneath the horizontal reference line 0.

Figure 7:
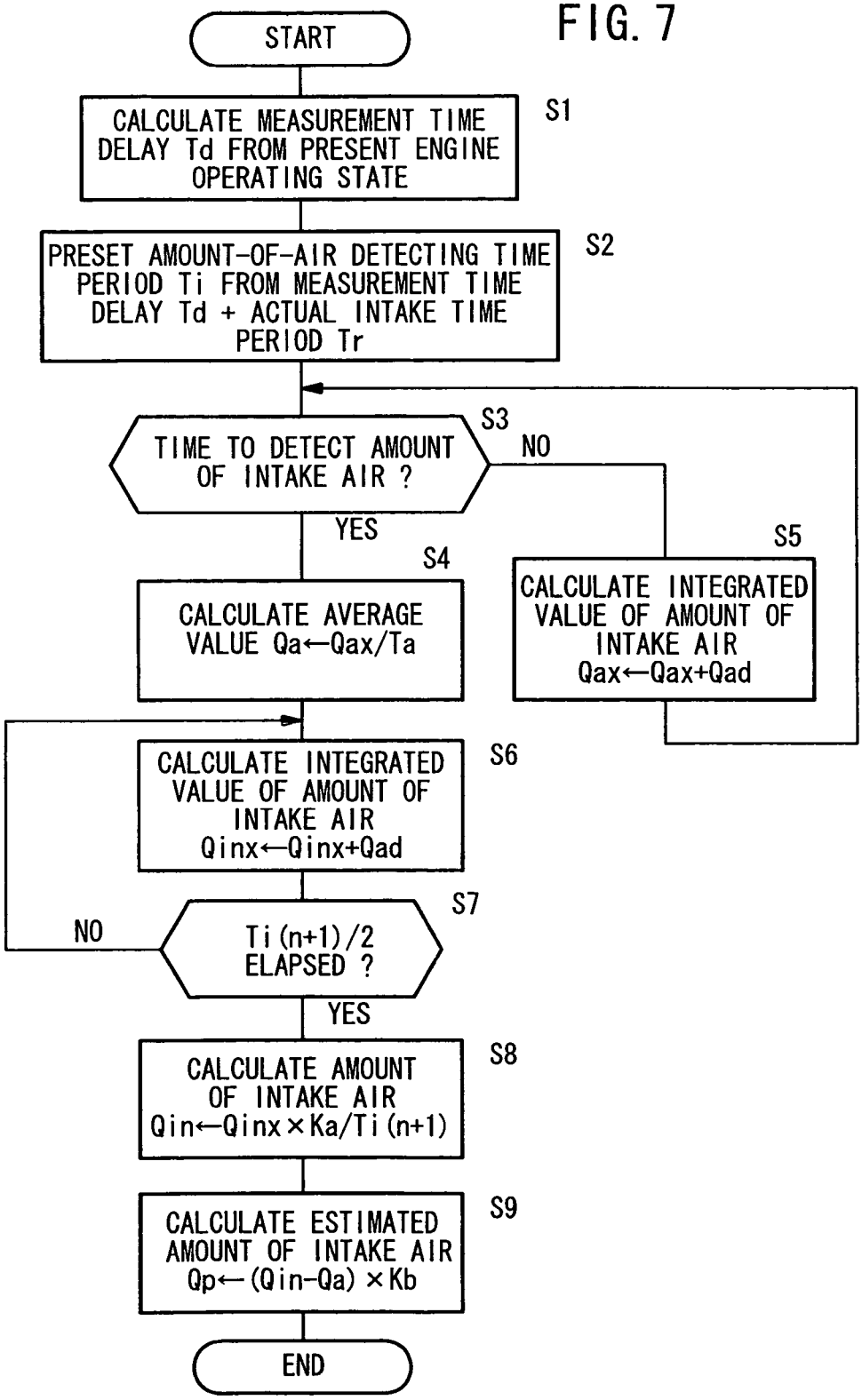
FIG. 7 is a flowchart of a process for estimating an amount of introduced intake air by correcting the amount of introduced intake air detected by the air flow meter, based on the amounts of intake air that are actually introduced into the cylinders.

In step S1 shown in FIG. 7, a measurement time delay Td is calculated as the difference between the time when intake air is actually drawn into the fourth cylinder chamber 12*d*, based on the present operating state of the engine 14, and the time when intake air flowing through the bypass pipe 58 is detected by the air flow meter 72. As shown in FIG. 6, the time when the amount of intake air flowing through the bypass pipe 58 is detected by the air flow meter 72 is slightly later than the time when intake air is actually drawn into the fourth cylinder chamber 12*d*.

In step S2, an actual intake time period Tr during which intake air is actually drawn into the fourth cylinder chamber 12*d* is measured. An elapsed time period, which is equal to the actual intake time period Tr from the time when the measurement time delay Td elapses, i.e., a start point A, is set as an amount-of-air detecting time period Ti (Tr= Ti) for measuring the amount of intake air with the air flow meter 72. Therefore, when the amount-of-air detected time period Ti is completed at an end point B, the sum of the measurement time delay Td and the actual intake time period Tr has elapsed.

In step S3, it is determined whether the present time is a time to detect an amount of intake air with the air flow meter 72, i.e., whether the present time is in the amount-of-air detecting time period Ti in a next intake stroke. If the present time is a time to detect an amount of intake air with the air flow meter 72, then control goes to step S4. If not, then control goes to step S5.

In step S4, an amount of intake air that is drawn in a time period other than the amount-of-air detecting time period Ti, i.e., in a time period between the amount-of-air detecting time period Ti(n) in the preceding intake stroke and the amount-of-air detecting time period Ti(n+1) in the present intake stroke, is detected by the air flow meter 72, and an integrated value Qax of the amount of intake air is calculated based on the detected amount of intake air.

The integrated value Qax of the amount of intake air is divided by the time period Ta between the amount-of-air detecting time period Ti(n) in the preceding intake stroke and the amount-of-air detecting time period Ti(n+1), i.e., the time period other than the amount-of-air detecting time period Ti, thereby calculating an average value Qa of the amount of intake air between the amount-of-air detecting time period Ti(n) in the preceding intake stroke and the amount-of-air detecting time period Ti(n+1) in the present intake stroke. The amount of intake air that flows from the tank 40 back into the bypass passage 58 is calculated as the integrated value Qax of the amount of intake air.

An amount of intake air flowing in a stable flow state prior to the amount-of-air detecting time period Ti(n+1) in the present intake stroke may be detected, and an average value Qa' of the detected amount of intake air may also be used, instead of the above average value Qa of the amount of intake air.

If the present time is not a time to detect an amount of intake air with the air flow meter 72 in step S3, then an instantaneous amount Qad of intake air is gradually added to the integrated value Qax of the amount of intake air that is drawn between the amount-of-air detecting time period Ti(n) in the preceding intake stroke and the amount-of-air detecting time period Ti(n+1) in the present intake stroke, and a final integrated value Qax of the amount of intake air is calculated in step S5. Thereafter, control goes back to step S3.

In step S6, the instantaneous amount Qad of intake air is gradually added to an integrated value Qinx of the amount of intake air, which is detected by the air flow meter 72 in the amount-of-air detecting time period Ti(n+1), and integrated in the amount-of-air detecting time period Ti(n+1).

In step S7, it is confirmed whether one half (Ti(n+1)/2) of the amount-of-air detecting time period Ti(n+1) in the present intake stroke has elapsed. If one half (Ti(n+1)/2) of the amount-of-air detecting time period Ti(n+1) has already elapsed, then control goes to step S8. If one half (Ti(n+1)/2) of the amount-of-air detecting time period Ti(n+1) has not yet elapsed, then control goes back to step S6.

In step S8, the integrated value Qinx of the amount of intake air is multiplied by an amount-of-air correcting coefficient Ka, so that the integrated value Qinx of the amount of intake air, which is detected in one half of the detecting time, is turned into an integrated value of the normally detected amount of intake air. Thereafter, the integrated value Qinx of the amount of intake air as multiplied by the amount-of-air correcting coefficient Ka is divided by the amount-of-air detecting time period Ti(n+1), thereby calculating an amount Qin of intake air in the amount-of-air detecting time period Ti(n+1).

Finally, in step S9, the average value Qa of the amount of intake air between the amount-of-air detecting time period Ti(n) in the preceding intake stroke and the amount-of-air detecting time period Ti(n+1) in the present intake stroke is subtracted from the amount Qin of intake air, and the difference is multiplied by a correcting coefficient Kb, producing an estimated amount Qp of intake air to be drawn into the fourth cylinder chamber 12*d*. The correcting coefficient Kb is established for the purpose of stabilizing the numerical values of the amount of intake air that is detected by the air flow meter 72 when the intake air flows backward upstream in the bypass pipe 58. If no intake air flows backward upstream in the bypass pipe 58, then the amount Qp of intake air is estimated without subtracting the average value Qa of the amount of intake air from the amount Qin of intake air.

Based on the estimated amount Qp of intake air, the controller 78 outputs a control signal to the injector 56, and the engine 14 is controlled based on the estimated amount Qp of intake air that is produced in the present cycle, according to the process shown in FIG. 7.

In the above process, an amount of intake air drawn into the fourth cylinder chamber 12*d* of the fourth cylinder C4 of the engine 14 is estimated. The same process as described above is performed to estimate an amount of intake air drawn into the first cylinder C1 disposed adjacent to one of the side walls 57*a* of the tank 40, or into each of the third and fourth cylinders C3, C4 disposed remotely from the side walls 57*a* of the tank 40. Therefore, the process for estimating the amount of intake air drawn into the first, third, and fourth cylinders C1, C3, C4 will not be described in detail below.

The intake manifold 34 incorporated in the intake system 10 is not limited to a down-draft type, as described above, but may be a side-draft type, wherein a common pipe and branch pipes extend in a direction substantially perpendicular to each other.

According to the present embodiment, as described above, in an engine 14 having the first through fourth cylinder chambers 12*a* through 12*d*, the amount-of-air detecting time period Ti for detecting the amount of intake air with the air flow meter 72 is set based on actual amounts Q1 through Q4 of intake air, which are actually drawn into the respective first through fourth cylinder chambers 12*a* through 12*d* in the preceding intake stroke, and the average value Qa of the amount of intake air between intake strokes in which the amount of intake air is detected, i.e., the average value of the amount of intake air flowing backward in the bypass pipe 58, is calculated. If the air flow meter 72 confirms that one half of the amount-of-air detecting time period Ti(n+1) in the present intake stroke has elapsed, then the average value Qa of the amount of intake air between the preceding and present intake strokes is subtracted from the amount Qin of intake air in the present intake stroke, and the difference is multiplied by the correcting coefficient Kb, thereby producing the estimated amount Qp of intake air in the present intake stroke.

Therefore, when the intake air introduced into the intake manifold 34 flows from the tank 40 back into the bypass pipe 58, the amount of intake air that is actually drawn into the cylinder chamber in the present intake stroke can be estimated highly accurately, without being affected by the backward flow of intake air in the bypass pipe 58.

Consequently, even when the bypass pipe 58 is connected to the first and/or fourth branch pipes 36*a*, 36*b* of the intake manifold 34, the amount of fuel injected into the cylinder can be controlled highly accurately based on the estimated amount Qp of intake air, without being affected by the backward flow of intake air in the bypass pipe 58. It is thus possible to optimize the amount of intake air introduced into the first and/or fourth cylinder chambers 12*a*, 12*d*, and to optimize the air-fuel ratio, which is the ratio of intake air to the fuel injected into the intake air. The engine 14 can be controlled highly accurately in real time, based on the amount of fuel to be injected and the amount of intake air.

Since the bypass pipe 58 is not connected to the first and second branch pipes 36*a*, 36*b*, the amount of intake air introduced into the first and second cylinder chambers 12*a*, 12*b* is estimated based on the amount of intake air introduced into the third and fourth cylinder chambers 12*c*, 12*d* through the third and fourth branch pipes 36*c*, 36*d*, to which the bypass pipe 58 is connected.

Because the amount of intake air flowing through the bypass pipe 58 can be estimated without being affected by the backward flow of intake air from the tank 40 into the bypass pipe 58, the amount of intake air introduced into the first and second cylinder chambers 12*a*, 12*b* can be estimated simply and highly accurately, based on the amount of intake air introduced into the third and fourth cylinder chambers 12*c*, 12*d*.

Since the amount of intake air flowing through the bypass pipe 58 can be estimated without being affected by the backward flow of intake air from the tank 40 into the bypass pipe 58, when branch pipes of the intake manifold 34 are selected for connection to the intake pipe 58, it is unnecessary to take into account whether the branch pipes would cause a backward flow of intake air or not. Therefore, the layout for the bypass pipe 58, and the branch pipes connected thereto, can be designed freely.

The above process for controlling operation of the internal combustion engine allows the intake system 10, which includes the air flow meter 72 for detecting intake air flowing through the bypass pipe 58, to be applied irrespective of the type of the engine 14, e.g., an in-line type or a V-type of engine, and the configuration of the intake manifold 34. The bypass pipe 58 may be designed in an optimum layout for making both the engine 14 and the intake system 10 compact.

As shown in FIG. 6, the amount Qin of intake air detected by the air flow meter 72 is represented by a mountain-shaped curve having a crest T in each intake stroke. Therefore, in step S7 shown in FIG. 7, the air flow meter 72 can stop detecting the amount of intake air at the crest T where the amount Qin of intake air is maximum, for detecting about one half (shown hatched) of the amount Qin of intake air. The controller 78 can correct the amount of intake air, which is about one half the normally detected amount of intake air, with the correcting coefficient Ka, to calculate the total amount Qin of intake air.

Therefore, the time period required to detect the amount Qin of intake air is reduced by about one half. In addition, the time period required to calculate the actual amount Qin of intake air in the controller 78, based on the detected amount of intake air, can be shortened. Consequently, the time period required to calculate the actual amount Qin of intake air is shorter than if the entire actual amount Qin of intake air were detected by the air flow meter 72. As a result, the accuracy, at which the amount of intake air is detected by the air flow meter 72, is increased, and the engine 14 can be controlled with higher accuracy.

Although a certain preferred embodiment of the present invention has been shown and described in detail, it should be understood that various changes and modifications may be made therein without departing from the scope of the appended claims.

What is claimed is:

1. A method of controlling operation of an internal combustion engine having a main body, an intake manifold connected to said main body and having a plurality of parallel branch pipes and a common pipe held in communication with said branch pipes, said intake manifold having a main intake passage defined therein, a throttle valve connected to said common pipe and openable and closable for regulating intake air drawn through said main intake passage into the internal combustion engine, an auxiliary intake passage disposed separately from said main intake passage and connected to said branch pipes in communication with said main intake passage, and an amount-of-air detector disposed in said auxiliary intake passage for detecting an amount of intake air drawn through said auxiliary intake passage into the internal combustion engine, said method comprising the steps of:

dividing an integrated value of the amount of intake air detected by said amount-of-air detector between a preceding intake stroke and a present intake stroke by a time period between said preceding intake stroke and said present intake stroke, thereby calculating an average value of the amount of intake air;

calculating the integrated value of the amount of intake air detected by said amount-of-air detector within a preset amount-of-air detecting time period based on an actual amount of intake air that is actually drawn into the internal combustion engine in said preceding intake stroke;

determining whether a predetermined time period in the preset amount-of-air detecting time period has elapsed after said amount-of-air detector has started detecting the amount of intake air in the present intake stroke;

after confirming that one half or more of the preset amount-of-air detecting time period has elapsed, multiplying the integrated value of the amount of intake air detected in said one half of the preset amount-of-air detecting time period by a correcting coefficient, and then dividing by said preset amount-of-air detecting time period, thereby calculating an amount of intake air detected in said preset amount-of-air detecting time;

subtracting the average value of the amount of intake air between the preceding intake stroke and the present intake stroke from the amount of intake air detected in said preset amount-of-air detecting time, and multiplying the difference by a correcting coefficient, thereby calculating an estimated amount of intake air to be drawn into the internal combustion engine; and supplying the estimated amount of intake air to the internal combustion engine to control operation of the internal combustion engine.

2. A method according to claim 1, further comprising the step of:

if the present time is not in the preset amount-of-air detecting time period in an intake stroke for detecting the amount of intake air, detecting the amount of intake air between the preceding intake stroke and the present intake stroke with said amount-of-air detector, thereby calculating the integrated value of the amount of intake air.

3. A method according to claim 1, further comprising the step of:

if the predetermined time period in the preset amount-of-air detecting time period has not elapsed after said amount-of-air detector has started detecting the amount of intake air in the present intake stroke, calculating the integrated value of the amount of intake air detected by said amount-of-air detector.

4. A method of controlling operation of an internal combustion engine having said main body, an intake manifold connected to the main body and having a plurality of parallel branch pipes and a common pipe held in communication with said branch pipes, said intake manifold having a main intake passage defined therein, a throttle valve connected to said common pipe and openable and closable for regulating intake air drawn through said main intake passage into the internal combustion engine, an auxiliary intake passage disposed separately from said main intake passage and connected to said branch pipes in communication with said main intake passage, and an amount-of-air detector disposed in said auxiliary intake passage for detecting an amount of intake air drawn through said auxiliary intake passage into the internal combustion engine, said method comprising the steps of:

calculating a detecting time difference between an actual intake time period during which intake air is actually drawn into the internal combustion engine and a time when an amount of intake air is detected by the amount-of-air detector in a preceding intake stroke of the internal combustion engine;

adding the actual intake time period in the preceding intake stroke to said detecting time difference, thereby presetting an amount-of-air detecting time period for detecting the amount of intake air with said amount-of-air detector;

determining whether the present time is in the amount-of-air detecting time period in an intake stroke for detecting the amount of intake air;

determining whether one half or more of the preset amount-of-air detecting time period has elapsed after said amount-of-air detector has started detecting the amount of intake air in the present intake stroke;

if it is confirmed that one half or more of the preset amount-of-air detecting time period has elapsed, calculating an estimated amount of intake air to be actually drawn into the internal combustion engine based on the amount of intake air detected in said amount-of-air detecting time period; and supplying the estimated amount of intake air to the internal combustion engine to control operation of the internal combustion engine.

* * * * *